United States Patent [19]

Andrews

[11] Patent Number: 4,828,394

[45] Date of Patent: May 9, 1989

[54] RELATING TO VIBRATORY MACHINES

[76] Inventor: Robin D. R. Andrews, 299, Cirencester Road, Cheltenham, Gloucestershire, Great Britain

[21] Appl. No.: 77,084

[22] Filed: Jul. 17, 1987

[51] Int. Cl.[4] ..... B01F 11/00; B24B 31/06

[52] U.S. Cl. ..... 366/110; 366/116; 366/128; 51/163.2

[58] Field of Search ..... 366/108, 111, 110, 116, 366/125, 128, 602; 248/186; 198/577, 578; 51/313, 383 R, 163.1, 163.2

[56] References Cited

U.S. PATENT DOCUMENTS

| | | | |
|---|---|---|---|
| 1,536,985 | 5/1925 | Swinford | 248/186 |
| 2,072,877 | 3/1937 | Green | 248/186 |
| 2,175,321 | 10/1938 | Saffir | 366/602 |
| 2,973,606 | 3/1961 | Brandt | 366/128 |
| 3,271,012 | 9/1966 | Van Bael | 366/108 |
| 3,429,560 | 2/1969 | Huber | 366/111 |
| 3,587,193 | 6/1971 | Lewis | 366/111 |
| 3,877,178 | 4/1975 | Campanelli | 51/313 |
| 4,207,005 | 6/1980 | Stanfield | 366/128 |
| 4,473,918 | 10/1984 | Moss et al. | 15/144 R |
| 4,550,622 | 11/1985 | LaBonte et al. | 366/116 |

FOREIGN PATENT DOCUMENTS

| | | | |
|---|---|---|---|
| 168524 | 9/1985 | Japan | 366/128 |
| 497425 | 12/1938 | United Kingdom | 366/128 |
| 2145389 | 3/1985 | United Kingdom | 366/108 |

OTHER PUBLICATIONS

McMaster-Carr Supply Company Catalog, Catalog No. 85; Date 1979; pp. 1538–1539.

*Primary Examiner*—Harvey C. Hornsby
*Assistant Examiner*—Joseph S. Machuga
*Attorney, Agent, or Firm*—Young & Thompson

[57] ABSTRACT

This invention relates to vibratory machines such as grinding machines. A machine 10 has a vibratory unit 13 which is connected to a separate motor 12 by a flexible drive 14. The drive rotates a shaft 23 carrying eccentric weights 25,26 and the resultant gyratory movement is transmitted directly to a vibratory plate 16 through bearings 24. The amplitude vibration can be altered by adjusting the relative position of the weights.

6 Claims, 3 Drawing Sheets

$G_1$ - POSITION OF CENTRE OF GRAVITY OF WEIGHT 20b $G_2$ - POSITION OF CENTRE OF GRAVITY OF WEIGHT 20a

G - COMBINED CENTRE OF GRAVITY IN POSITION DRAWN

RELATING TO VIBRATORY MACHINES

This invention relates to vibratory machines and in particular, but not exclusively, grinding machines.

Commonly, the machinery is arranged to impart a circular motion to material within a grinding chamber, such that the centre of gravity of the machine in one plane performs a substantial circular orbit around the rest centre of gravity of the machine The diameter of this orbit is known as the amplitude of vibration. The gyratory action is created by the rotation of weights whose combined centre of gravity is offset from the axis of rotation and which are supported in a cantilever fashion on the rotary bearings of a motor. The amplitude of the consequent circular motion is dependent on the speed of rotation (w) the eccentricity (e) and the mass (m) of the weights. Their algebraic product ($mew^2$) governs the amplitude of the motion.

These current arrangements put considerable stress on the motor and with the result expensive specialised motors have to be provided which are often of considerable size. In order to provide for different grinding rates and materials the motors also have to be of two or variable speed, again increasing their expense.

It is an object of the present invention to provide an improved vibratory machine which mitigates against at least some of the above mentioned disadvantages.

From one aspect the invention consists in a vibratory machine including a vibratable element, means for mounting the element for vibratory movement in a plane, actuating means for imparting said vibratory movement to the element, a motor for driving the actuating means and flexible drive means for drivingly connecting the motor and the actuating. means.

In a preferred embodiment, the machine includes a frame, and the motor is mounted on the frame remote from the mounting means, which itself resiliently mounts the element on the frame. Conveniently the motor is placed below the vibratory element and displaced from the actuating means.

The actuating means may comprise a rotatable shaft having an eccentric mass fixed thereto and the shaft may be mounted on the element such that radial movements of the shaft induced by the eccentric mass are transmitted to the element. The eccentric mass may comprise a plurality of relatively moveable segments which can be locked together in a plurality of positions such that the relative positions of the segments determine the amplitude of the radial movements of the shaft for a given rotational speed of the shaft. For example, at least one segment may be fixed to the shaft and another may be rotationally mounted on the shaft. In that case, one of the segments may be provided with a plurality of apertures for lockingly receiving a pin or the like which is itself attached to another segment.

The vibratory element may carry a chamber which can be clamped thereto by a toggle mechanism the toggle mechanism being formed such that in its clamping position the lever of the toggle mechanism has passed through the toggle centre.

From another aspect the invention consists in a vibratory machine, including a vibratable element for vibratory movement in a plane, a shaft rotatably mounted on the element, an eccentric mass fixed to the shaft and means for rotating the shaft, the arrangement being such that when the shaft is rotated the eccentric mass induces radial movement of the shaft which is transmitted to the vibratable element.

The eccentric mass may be made up of a plurality of segments as set out above

From another aspect the invention includes a vibratory machine having a chamber and a vibratable element and further including a toggle clamping mechanism for clamping the chamber to the element, the toggle mechanism being so constructed that the operating lever passes through the toggle centre when moved into its operating position.

Although the invention has been described above it will be appreciated that it includes any inventive combination of the features set out above or in the following description.

The invention may be performed in a number of ways, and their specific embodiment will now be described, by way of example, with reference to the accompanying drawings in which.

Figure 1:
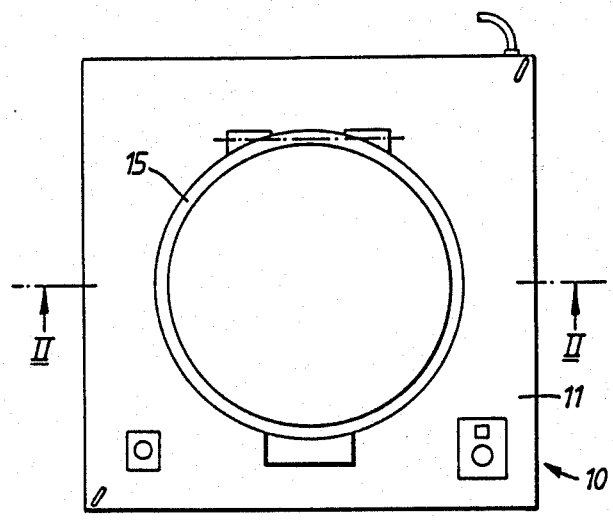
FIG. 1 is a plan view of a vibratory machine.
Figure 2:
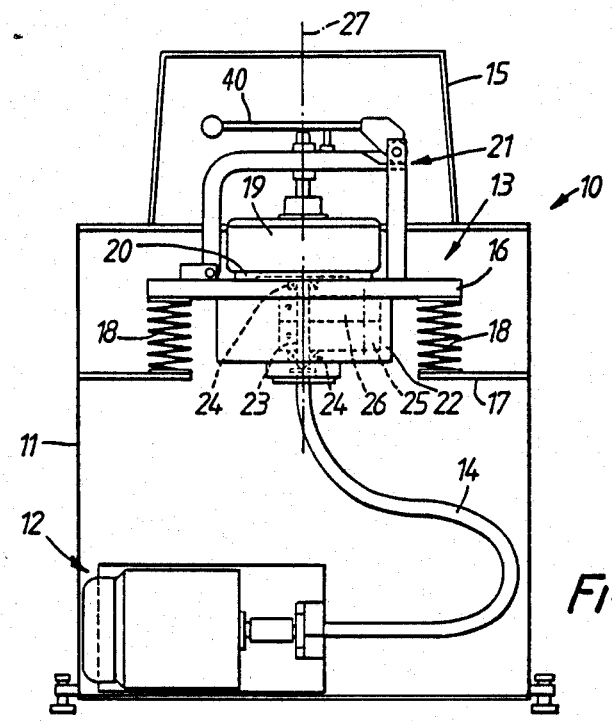
FIG. 2 is a part sectional view along the line II—II.

A vibratory machine generally indicated at 10 comprises a frame 11, a motor 12, a vibratory unit 13, connected to the motor 12 by a flexible drive 14 and a cover 15 to provide access to the vibratory unit 13.

The vibratory unit 13 has a vibratable plate or element 16 which is mounted on the frame 11 by means of an annular support plate 17 and spaced springs 18. The plate 16 carries a grinding or work chamber 19 on its upper face by means of a rubber buffer 20. It also carries a toggle mechanism 21 for clamping the chamber 19 to the plate 16 during operation of the machine. A casing 22 is attached to the lower face of the plate 16 and encloses a shaft 23 which is rotatably mounted therein by bearings 24 whose outer races are fixed to the plate 16 either directly or via the casing 22. Eccentric weights 25,26 are carried on the shaft in a manner which will be described in more detail below. The shaft is drivingly connected to the motor 12 by the drive 14.

In use, the. motor 12 rotates the shaft 23 causing the shaft to move around the centre line 27 of the machine due to the eccentric weights 25,26 mounted thereon. This movement is transmitted to the plate 16 through the bearings 24 and hence to the chamber 19. The springs 18 are chosen such that they substantially restrict the vibratory movement to the plane of the plate 16 and this is particularly advantageous in certain grinding operations where movement perpendicular to this plane can be extremely damaging.

It will be noted that the motor is thus held substantially isolated from the induced vibrations and accordingly quite standard, and hence inexpensive motors, can be utilized. Because the motor structure itself does not need to carry the weight of the eccentric weights it can also be of smaller dimension. It is preferred that the motor is displaced as far as possible from the axis of rotation of the shaft in order to reduce the curvature or kink needed in the drive 14. It is also preferred that the motor is disposed below the vibratory unit 13 because this allows lubricating grease or oil, which is pumped up the shaft during use, to flow back down towards the motor in between use cycles.

The toggle mechanism 21 is designed so that its operating lever 40 has passed through the toggle centre of the mechanism when it reaches its clamping position (see FIG. 1). This means that considerable work would have to be done to release the lever and hence it is protected against accidental unclamping due to vibration in use.

Figure 3:
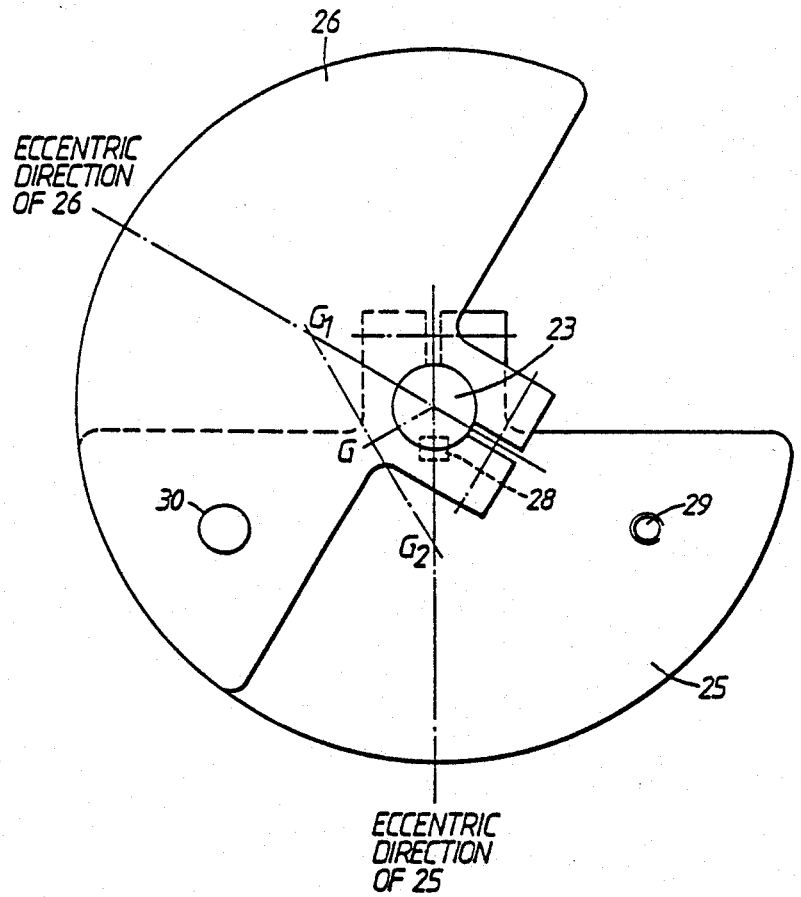
FIG. 3 is an enlarged detailed view of the eccentric weights of the machine of FIGS. 1 and 2.

Turning to FIG. 3, it will be seen that one of the weights 25 is keyed to the shaft 23 at 28, whilst the other weight 26 is rotatably mounted on the shaft 23. The fixed weight 25 is provided with a plurality of circumferentially spaced apertures (one of which is shown at 29) which threadingly receive a bolt 30, which passes through the rotatable weight 26. In this way, the effective centre of gravity of the two weights can be adjusted so as to vary its distance from the axis of rotation of the shaft 23 by altering the degree of overlap by the weights. Once the position is selected corresponding to an aperture 29 the weights are locked in that relative position by the bolt 30. Thus, when the centres of gravity of the weights overlap the vibration amplitude is at a maximum whereas when they are in the position shown in FIG. 3, a lower amplitude can be achieved. It is thus possible to alter the amplitude of vibration without the need for a variable speed motor.

The locking arrangement described can be locked and unlocked by an Allen Key passed through the top of the frame 11, but it may be easier to have the bolt spring-loaded so that it can be disengaged simply by depressing the weights. Various suitable arrangements can be envisaged.

Because the rotational forces in this arrangement are carried directly into the vibratory plate through the bearings and not through the motor, the damage to the motor is considerably reduced. Further, as the vibratory plate no longer needs to carry the motor, its size can be reduced and hence there is a reduction in the power needed to achieve any particular amplitude of vibration.

Figure 4:
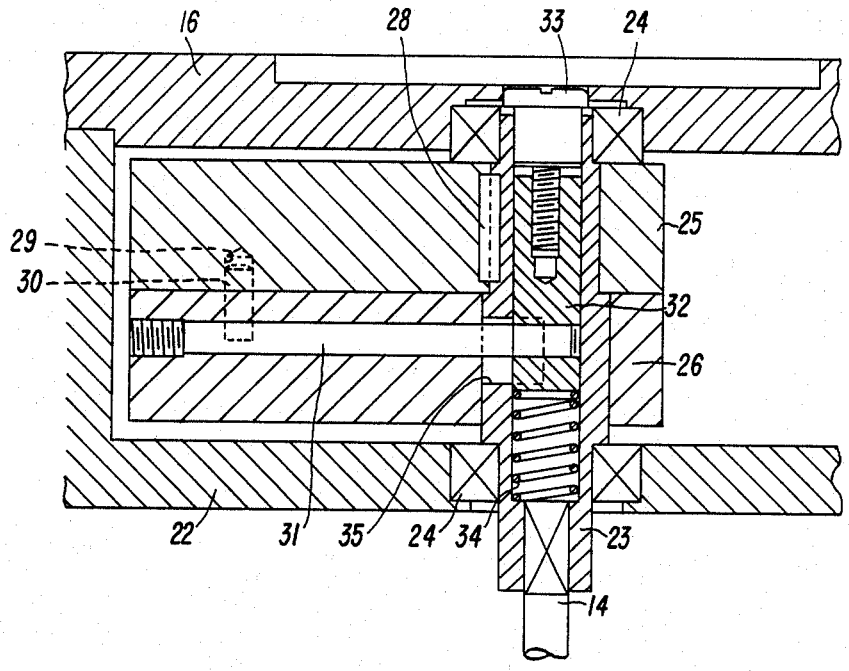
FIG. 4 is an enlarged view of the weights, illustrating a method of adjustment.

FIG. 4 illustrates a construction which allows particularly easy adjustment of the weights. Here the fixed weight 25 is uppermost and, the lower movable weight 26 is connected by a rod 31 to a spring loaded plunger 32, which can be depressed and rotated by a screwdriver acting on screwhead 33 against the action of compression spring 34. A slot 25 is formed in the wall of shaft 23 to allow the resultant movement of the bolt 31. In use depression of the plunger 32 drops the weight 26 so that the pin 30 falls clear of the aperture 29. The weight 26 is then rotated by the plunger 32 until the pin 30 is aligned with the desired aperture 29. Release of the plunger 32 then allows the spring. 34 to lift the weight 26 and hence engages the pin 30 in the weight 25.

I claim:

1. A grinding machine including a vibratable element, means for mounting a container on the element, means for mounting the element for vibratory movement in a plane, actuating means for imparting said vibratory movement to the element and including a generally vertical rotatable shaft having an eccentric mass mounted thereon, a motor for driving the shaft located beneath the shaft and disposed with the axis of its output shaft extending generally horizontally and a flexible drive shaft extending between the motor and the actuating means along a three-dimensionally curved path and drivingly connecting the motor and the shaft, wherein the rotatable shaft of said actuating means is disposed in a first vertical plane parallel to the motor and in a second vertical plane perpendicular to said first vertical plane, and wherein the motor is displaced from said first and second vertical planes.

2. A grinding machine as claimed in claim 1, wherein the means for mounting the container on the element comprises a toggle mechanism, the toggle mechanism being formed such that in its clamping or locking position the lever of the toggle mechanism is passed through the toggle centre.

3. A grinding machine as claimed in claim 1, wherein the eccentric mass comprises a plurality of relatively movable segments which can be locked together in a plurality of positions such that the relative positions of the segments determine the amplitude of radial movement of the shaft for a given rotation speed of the shaft and wherein the shaft is hollow to receive an amplitude control element to which one segment is connected through the wall of the shaft, the arrangement being such that axial and rotational movement of the control element causes corresponding movement of the segment to allow it to be disengaged from the other segment and subsequently re-engaged in a different relative position.

4. A grinding machine as claimed in claim 3, further comprising resilient means for urging the control element axial to releasably hold the segments locked together.

5. A vibratory machine including a vibratable element for vibratory movement in a plane, a shaft rotatably mounted on the element, a plurality of relatively movable eccentric mass segments mounted to the shaft, means for rotating the shaft such that when the shaft is rotated the segments induce radial movement of the shaft which is transmitted to the vibratable element, the segments being such that they can be locked together in a plurality of positions such that the relative position of the segments determine the amplitude of the radial movement of the shaft for a given rotational speed of the shaft and wherein the shaft is hollow to receive a movable control element to which one segment is connected through the wall of the shaft, the arrangement being such that axial and rotational movement of the control element causes corresponding movement of the segment to allow it to be disengaged from the other segment and subsequently re-engaged in a different relative position.

6. A vibratory machine as claimed in claim 5, further comprising resilient means for urging the control element axially to releasably hold the segments locked together.

* * * * *